US005503536A

United States Patent [19]

Waldenstrom et al.

[11] Patent Number: 5,503,536

[45] Date of Patent: Apr. 2, 1996

[54] ROLLING WHEEL ACTUATED PUMP AND PUMP SYSTEM

[75] Inventors: Carl G. Waldenstrom, Grayslake, Ill.; Xudong Yu, Brookfield, Wis.

[73] Assignee: Applied Power Inc., Butler, Wis.

[21] Appl. No.: 257,848

[22] Filed: Jun. 10, 1994

[51] Int. Cl.[6] ..... E04B 9/00; B61K 3/00

[52] U.S. Cl. ..... 417/229; 417/214; 417/540; 184/3.1

[58] Field of Search ..... 417/214, 535, 417/540, 229; 184/3.1

[56] References Cited

U.S. PATENT DOCUMENTS

| | | | |
|---|---|---|---|
| 2,238,732 | 4/1941 | Huber et al. | 184/3 |
| 3,006,148 | 10/1961 | Hause | 417/214 |
| 3,655,296 | 4/1972 | McDougall | 417/214 |
| 4,211,078 | 7/1980 | Bass | 417/229 |
| 4,214,647 | 7/1980 | Lutts | 184/3 A |
| 4,334,596 | 6/1982 | Lounsberry, Jr. | 184/3 A |
| 4,515,530 | 5/1985 | Christoleit | 417/214 |
| 4,856,617 | 8/1989 | Lounsberry, III et al. | 184/3.1 |

OTHER PUBLICATIONS

M&S Moore & Steele Corporation brochure: "The 761 Hydraulube™ Hydraulic Rail Lubricator", admitted prior art.

*Primary Examiner*—Richard A. Bertsch
*Assistant Examiner*—William Wicker
*Attorney, Agent, or Firm*—Quarles & Brady

[57] ABSTRACT

A pump having a reciprocating piston/plunger unit adapted to be actuated by a railway wheel rolling over it has a unitary plunger and piston, with the piston double-acting so that when the outlet pressure exceeds a certain value, the plunger remains retracted. An accumulator is provided in fluid communication with the outlet so as to store accumulated hydraulic pressure.

4 Claims, 1 Drawing Sheet

ROLLING WHEEL ACTUATED PUMP AND PUMP SYSTEM

BACKGROUND OF THE INVENTION

1. Field of the Invention

This invention relates to hydraulic pumping systems which are charged by the actuation of a wheel rolling over a plunger of a pump, and particularly to such a pump and pumping system particularly adapted for rail wheels, for example of a passenger or freight train.

2. Discussion of the Prior Art

It is known to use the rolling energy of a wheel, for example of a train wheel, as the input energy for a hydraulic pump. For example, such devices are described in U.S. Pat. No. 4,334,596. In U.S. Pat. No. 4,334,596, a rail wheel rolls over a pump plunger, and as it does so, depresses the plunger. The plunger is connected to a hydraulic piston by a compression spring, so that when the spring compresses, the hydraulic piston shifts. After the wheel rolls over the plunger, the first spring returns the plunger to its extended position and the second spring returns the hydraulic piston to its extended position.

In this arrangement, the plunger returns to its normal extended position under all conditions. Thus, even after the pump has been operated to produce the maximum system pressure, the plunger continues to be depressed by every wheel rolling over it. This results in needless hammering of the plunger every time a wheel rolls over it with attendant needless wear on sliding bearing surfaces of the pump, sliding seals and fatigue wear on the springs. In addition, the needless reciprocation of the plunger adds to needless energy input to the pump, which undesirably generates additional heat in the system.

SUMMARY OF THE INVENTION

The invention provides a wheel actuated hydraulic pump which eliminates needless reciprocation of the plunger and accordingly needless wear on the pump, to improve the longevity of the pump. The invention accomplishes this by preventing the plunger from returning to its extended position when the output pressure has reached a certain value.

In a preferred form, this is accomplished by applying a fluid pressure on a piston which moves axially with the plunger, to prevent the plunger from returning.

It is especially useful to incorporate this feature in a double acting pump. The pressure generated on the upstroke of the pump can therefore be used to prevent the plunger from returning when the force produced by that pressure exceeds the force of the spring which returns the plunger.

In a preferred system of the invention, a hydraulic accumulator is in fluid communication with the outlet of the pump. Thereby, fluid pressure is built up and stored by the accumulator, and when the system pressure becomes sufficiently high, the plunger remains retracted. Also with this system, the plunger and piston can be made integral with one another, thereby eliminating parts and simplifying the pump.

Other objects and advantages of the invention will be apparent from the detailed description and drawings.

DETAILED DESCRIPTION OF THE PREFERRED EMBODIMENT

Figure 1:
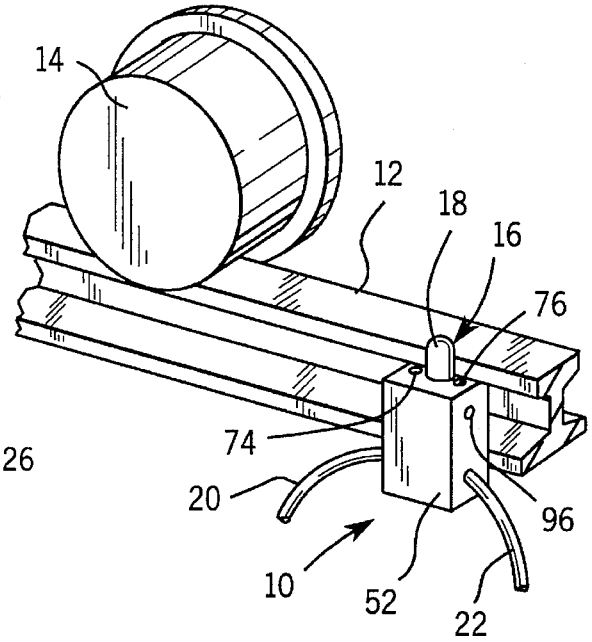
FIG. 1 is a perspective view illustrating a pump of the invention in an operative position relative to a rail and wheel.

Referring to FIG. 1, a pump 10 of the invention is illustrated in operative position adjacent to a rail 12 of the well-known type for supporting and guiding a flanged railway wheel 14 of a railroad car or locomotive (not shown). The railway 12 and wheel 14 may be of any suitable type to which the pump 10 can be adapted for depressing piston/plunger 16 of the pump 10. As the wheel 14, which extends slightly outward of the rail 12, rolls over the piston/plunger 16, the domed end 18 of the piston/plunger 16 is engaged and depressed by the cylindrical rolling surface of the wheel 14, which provides the input energy to operate the pump 10.

FIG. 1 also illustrates an inlet line 20 and an outlet line 22 coupled in operative fluid communication with the pump 10. These inlet and outlet lines 20 and 22 are also shown schematically in FIG. 2. The inlet line 20 is used to draw hydraulic fluid from a reservoir 24 and the outlet line 22 provides passage of hydraulic fluid to a hydraulic circuit or to hydraulic working units (not shown but indicated by arrowhead 26). Such working units may take the form of any devices needing a source of hydraulic pressure for operation, such as a hydraulic motor or hydraulic cylinder, for example to operate railway lubricators or a rail switch.

Figure 2:
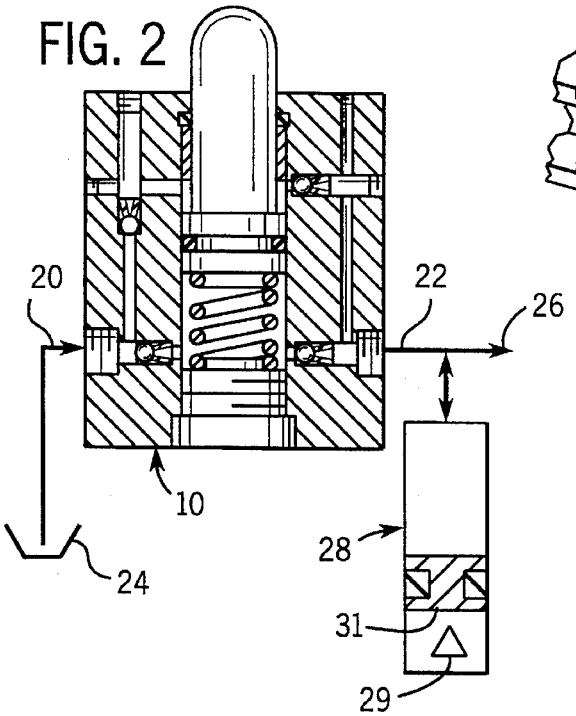
FIG. 2 schematically illustrates a pump of the invention incorporated in a hydraulic circuit.
Figure 3:
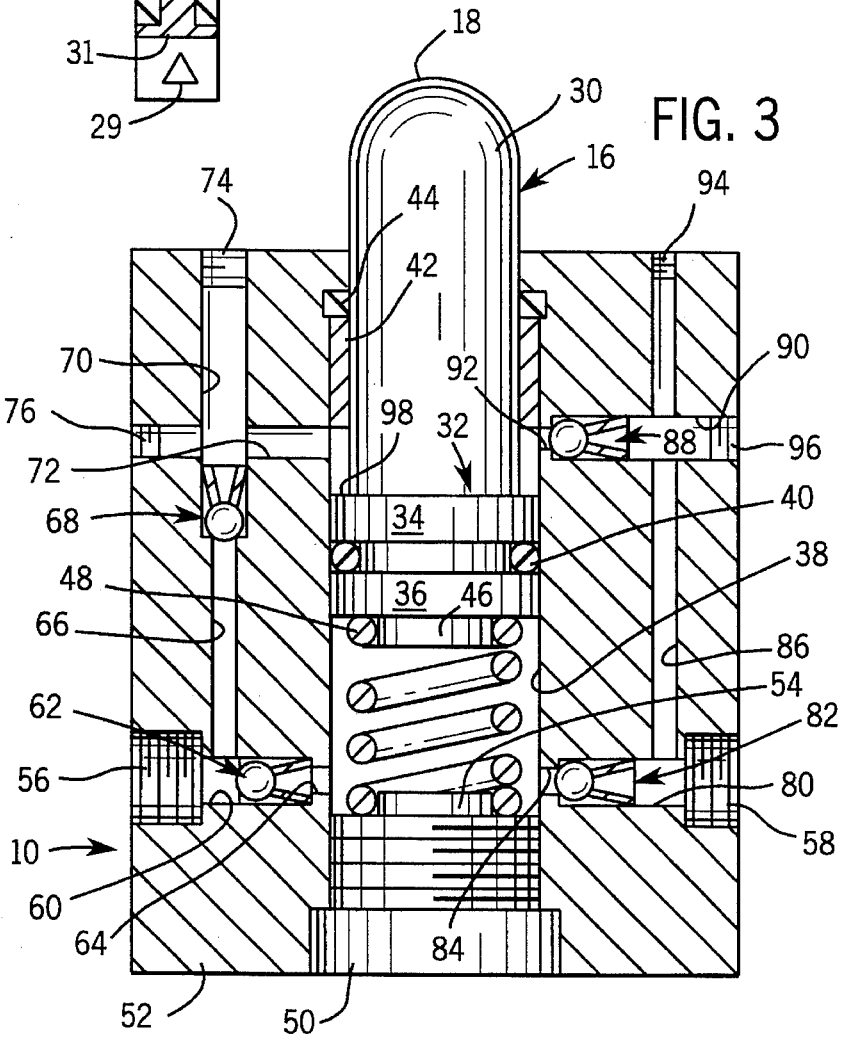
FIG. 3 is an enlarged cross-sectional view of the pump shown in FIGS. 1 and 2.

Outlet line 22 is also in fluid communication with an accumulator 28 to which hydraulic fluid may be pumped to build up and store hydraulic pressure. As is well known, when hydraulic fluid is pumped into the accumulator 28, the hydraulic pressure inside the accumulator 28, which is the same as the pressure at the outlet of the pump 10, increases proportionally with the volume of fluid pumped into the accumulator 28. When hydraulic fluid is withdrawn from the accumulator 28, for example by the operation of the hydraulic working units represented by arrowhead 26, the pressure in the accumulator 28, and therefore the outlet pressure of the pump 10, decreases. Accumulators of this type are well known and are available commercially. Preferably, the accumulator 28 used is of the gas charged variety, preferably being charged with nitrogen, such accumulators being available from a number of sources including Parker-Hanafin Corp., Fluid Power Group, Cleveland, Ohio 44114 and Oilair Hydraulics, Inc., Houston, Tex. 77040. In FIG. 2, a gas charge in accumulator 28 is schematically illustrated by arrowhead 29 acting on the lower side of piston 31, opposite from the hydraulic fluid side of piston 31.

The piston/plunger 16 is generally cylindrical, having a domed end 18, at the free end of plunger portion 30. The plunger portion 30 is coterminous and integral with piston portion 32 at the lower end of the plunger portion 30. The plunger portion 30 and the piston portion 32 therefore form an integral unit and the connection between the plunger portion 30 and the piston portion 32 is solid and therefore substantially inextensible and incompressible.

The piston portion 32 includes two enlarged cylindrical lands 34 and 36 which are of a diameter so as to form a close sliding fit with piston chamber 38. The lands 34 and 36 are spaced apart so as to define between them a groove in which a sliding O-ring seal 40 is positioned so as to provide a sliding fluid-tight seal between the part of the piston chamber 38 below the piston portion 32 and the part of the piston chamber 38 above the piston portion 32. A sleeve-type bearing 42 is pressed into or otherwise secured in the upper end of piston chamber 38 so as to journal the plunger portion 30 for axial reciprocating sliding motion. Above the bearing 42, a groove is formed in the piston chamber 38 which receives a fluid-tight seal 44 which surrounds the plunger portion 30 so as to create a sliding fluid-tight connection therewith.

Below the piston portion 32, a cylindrical stub 46 which is integral with the piston portion 32 extends and is slightly less in diameter than the inside diameter of a compression spring 48. The compression spring 48 is seated against the surface of piston portion 32 which is opposite from plunger portion 30 and extends downward therefrom to be seated at its opposite end against an assembly plug 50 which is threaded into the lower end of housing 52 and has a stub 54 which extends inside of the spring 48, similar to the stub 46, so as to retain the spring 48 between the piston portion 32 and the plug 50.

The housing 52 defines an inlet port 56 and an outlet port 58. Inlet line 20 is connected to inlet port 56 to establish fluid communication therewith and outlet line 22 is connected to outlet port 58 to establish fluid communication therewith. Inlet port 56 opens into passageway 60 in which a ball-type, spring-biased, one-way check valve 62 is installed. The outlet of the check valve 62 is in fluid communication with passageway 64 which opens into the piston chamber 38 below the piston portion 32. A passageway 66 communicates with passageway 60 upstream of check valve 62 and that its opposite end communicates with the inlet of a check valve 68 which is similar to the valve 62. Valve 68 is fixed in passageway 70 to which the outlet of valve 60 opens and which is in fluid communication with passageway 72 which opens into the piston chamber 38 above the piston portion 32. The ends of passageways 70 and 72 which open into the exterior surfaces of the housing 52 are threaded and capped with plugs 74 and 76 so as to prevent the egress of fluid out these ends.

The passages in fluid communication with outlet port 58 are largely the mirror image of the passages in fluid communication with the inlet port 56. Accordingly, the passageway 80 is in fluid communication with the outlet port 58 with a one-way check valve 82 providing one-way communication from passageway 84, which opens into the piston chamber 38 below the piston portion 32, to the outlet 58. A passageway 86 is also in communication with the outlet side of valve 82 and is in communication with a passageway 90 in which a similar one-way check valve 88 is installed. Valve 88 provides one-way communication from piston chamber 38 above the piston portion 32 through passageway 92 and via passages 90, 86 and 80 to outlet 58. The open ends of passageways 86 and 90 are capped by threaded plugs 94 and 96.

The pump 10 is double acting. In other words, it pumps hydraulic fluid on both its downstroke when the piston/plunger 16 is depressed, and on its upstroke, when the piston/plunger 16 returns to its extended position. On the downstroke, hydraulic fluid is admitted from inlet 66 through check valve 68 and passageway 72 into the piston chamber 38 above piston portion 32. The subatmospheric pressure in the piston chamber 38 above the piston portion 32 serves to open valve 68 (and tends to close valve 88 which is also closed by its spring and because it is acted on by the outlet pressure of the pump 10). The piston chamber 38 below the piston portion 32 is pressurized on the downstroke, thereby tending to close the valve 62 and open valve 82. Therefore, on the downstroke, fluid in the piston chamber 38 below the piston portion 32 is squeezed out past valve 82 to outlet 58, and fresh fluid is drawn into the chamber 38 above the piston portion 32 past valve 68. The downstroke is, of course, accomplished through the force of the rolling wheel pressing on domed end 18.

When the piston/plunger 16 reaches the bottom of its downstroke, assuming that the pressure limit of the system has not yet been met, the piston/plunger 16 begins its upstroke under the influence of spring 48. On the upstroke, subatmospheric pressure is created in the piston chamber 38 below the piston portion 32, thereby opening valve 62 to admit fluid into the chamber 38 below the piston portion 32. Valve 82 closes at the initiation of the upstroke, because it is spring biased in that position and because the pressure at outlet 58 exceeds the pressure in piston chamber 38 below the piston portion 32. On the upstroke, the piston chamber 38 above piston portion 32 pressurizes, thereby closing valve 68 and opening valve 88. Thus, on the upstroke, hydraulic fluid is squeezed out of piston chamber 38 above piston portion 32 past valve 88 and through passageways 90, 86 and 80 to outlet 58.

The piston/plunger 16 will continue to reciprocate with alternating full upstrokes and downstrokes until the set maximum system pressure is approached. The following describes what happens as the set maximum system pressure is approached and met.

An annular surface area 98 is defined on the piston portion 32, which is the axially facing area between land 34 and plunger portion 30 which is adjacent to the juncture between the plunger portion 30 and the piston portion 32. When the pressure in the piston chamber 38 above the piston portion 32 reaches the set maximum system pressure, the product of the pressure acting on the surface area 98 and this area will produce a force acting axially opposite to the force produced by the spring 48 which will overcome the spring 48 and prevent the spring 48 from returning the piston/plunger 16 to its fully extended position. Thereby, as the pressure in the piston chamber 38 above the piston portion 32 increases on the upstroke of the piston/plunger 16, when that pressure meets the set maximum system pressure, the upstroke stops. Thereafter, the next time the piston/plunger 16 is fully depressed to the bottom of its downstroke, the pressure at outlet 58 is further increased somewhat, thereby holding check valve 88 shut. Holding valve 88 shut prevents the egress of fluid from chamber 38, which generates a pressure in the chamber 38 above piston/plunger 16 acting on area 98 which is so high as to overcome the spring 48, thereby preventing the piston/plunger 16 from returning so that the piston/plunger 16 is held at or near the bottom of its stroke.

If fluid is withdrawn from the system after the set maximum system pressure is attained, thereby reducing the pressure at outlet 58 below the value at which the force produced by that pressure acting on surface 98 is less than the force of spring 48, the upstroke recommences, and pumping continues until a sufficiently high pressure is reached to again hold the piston/plunger 16 retracted. Thereby, needless reciprocation of the piston/plunger 16 is prevented.

It is noted that the set maximum system pressure can be adjusted by screwing plug 50 in or out, and can be further altered by replacing spring 48 with a stiffer or softer spring.

Preferred embodiments of the invention have been described in considerable detail. Many modifications and variations to the preferred embodiments will be apparent to those skilled in the art. For example, the plunger portion 30 need not be integral with the piston portion 32, so long as a connection is provided between the two portions so that they move axially together. Therefore, the invention should not be limited to the preferred embodiments described, but should be defined by the claims which follow.

We claim:

1. In a rolling wheel actuated hydraulic pump of the type having a housing, an inlet and an outlet in said housing, and a piston chamber in said housing in a flow path between said inlet and outlet, a reciprocable piston in said piston chamber, an actuator plunger for being depressed by said wheel as said wheel rolls in a path over said plunger to shift said piston in one direction and a spring for returning said piston in an opposite direction on a return stroke, the improvement wherein a pressure generated in said piston chamber by said piston compressing hydraulic fluid in said piston chamber on said return stroke balances a force exerted by said spring on said piston so as to hold said piston in a depressed position out of said path of said wheel when the outlet pressure of said pump exceeds a certain value;

said pump further comprises a one-way check valve in said outlet which permits flow only in a direction out of said piston chamber; and said pump is double acting so that it pumps fluid when said plunger is depressed and when said plunger returns.

2. The improvement as claimed in claim 1, wherein the plunger is directly connected to the piston so that they reciprocate together.

3. The improvement as claimed in claim 1, wherein said plunger and piston are unitary.

4. In a rolling wheel actuated hydraulic pumping system including a pump which has a plunger for being depressed by said wheel as said wheel rolls over said plunger, a piston for being shifted by said depression of said plunger, an inlet and an outlet, the improvement wherein the plunger and the piston move together axially and wherein said system further comprises a hydraulic accumulator in fluid communication with the outlet of said pump;

wherein said pump is double acting so that it pumps fluid to said accumulator when said plunger is depressed and when said plunger returns.

* * * * *